US007217327B2

(12) United States Patent
Eiraku et al.

(10) Patent No.: US 7,217,327 B2
(45) Date of Patent: May 15, 2007

(54) METHOD OF PRODUCING METAL MEMBER WITH ENHANCED CORROSION RESISTANCE BY SALT BATH NITRIDING

(75) Inventors: Hiroshi Eiraku, Tokyo (JP); Yutaka Sawano, Tokyo (JP); Tetsuya Yamamura, Tokyo (JP); Kuniji Yashiro, Tokyo (JP); Fumihide Nakamura, Tokyo (JP); Motohiro Tenmaya, Tokyo (JP)

(73) Assignees: Parker Netsushori Kogyo K.K., Tokyo (JP); Nihon Parkerizing Co., Ltd., Tokyo (JP)

( * ) Notice: Subject to any disclaimer, the term of this patent is extended or adjusted under 35 U.S.C. 154(b) by 253 days.

(21) Appl. No.: 10/651,978

(22) Filed: Sep. 2, 2003

(65) Prior Publication Data

US 2004/0040630 A1 Mar. 4, 2004

(30) Foreign Application Priority Data

Sep. 4, 2002 (JP) ..... 2002-258619

(51) Int. Cl.
*C23C 18/54* (2006.01)
*C23C 18/16* (2006.01)

(52) U.S. Cl. ..... 148/242; 148/206

(58) Field of Classification Search ..... 148/631, 148/242, 552; 523/404
See application file for complete search history.

(56) References Cited

U.S. PATENT DOCUMENTS

| | | | | |
|---|---|---|---|---|
| 2,248,732 | A * | 7/1941 | Albrecht et al. | 148/631 |
| 2,639,244 | A * | 5/1953 | Vordahl et al. | 148/242 |
| 3,268,372 | A | 8/1966 | Brotherton et al. | |
| 4,019,928 | A * | 4/1977 | Beyer et al. | 148/228 |
| 4,055,446 | A * | 10/1977 | Kunst et al. | 148/631 |
| 4,153,481 | A * | 5/1979 | Foreman et al. | 148/227 |
| 4,292,094 | A | 9/1981 | Kunst et al. | |
| 4,496,401 | A | 1/1985 | Dawes | |
| 4,608,092 | A | 8/1986 | Tremoureux et al. | |
| 5,346,560 | A | 9/1994 | Mournet et al. | |
| 5,514,226 | A | 5/1996 | Terrat et al. | |
| 5,518,605 | A * | 5/1996 | Hadj-Rabah et al. | 205/148 |
| 5,576,066 | A | 11/1996 | Polti | |
| 5,753,052 | A | 5/1998 | Dajoux | |
| 6,046,256 | A * | 4/2000 | Nakamura et al. | 523/404 |
| 6,395,109 | B1 * | 5/2002 | Peppler et al. | 148/335 |
| 2003/0075248 | A1 * | 4/2003 | Kato | 148/552 |

FOREIGN PATENT DOCUMENTS

| | | |
|---|---|---|
| EP | 0 497 663 | 8/1992 |
| GB | 1053243 | 12/1966 |
| WO | WO 02/44438 | 6/2002 |
| WO | WO 02/44438 A1 * | 6/2002 |

* cited by examiner

*Primary Examiner*—Roy King
*Assistant Examiner*—Jessee Roe
(74) *Attorney, Agent, or Firm*—Oblon, Spicak, McClelland, Maier & Neustadt, P.C.

(57) ABSTRACT

A metal member is produced with enhanced corrosion resistance by salt bath nitriding. Specifically, in a nitriding salt bath containing $Li^+$, $Na^+$ and $K^+$ ions as cation components and $CNO^-$ and $CO_3^{--}$ ions as anion components and enhanced in oxidizing power by addition of an oxidizing-power-enhancing substance selected from the group consisting of alkali metal hydroxides, bound water, free water and moist air, the metal member is immersed such that an nitrided layer is formed on a surface of the metal member and concurrently, an oxide film is formed on an outermost layer of the nitrided layer. As a subsequent step to the immersion in the nitriding salt bath, the metal member is immersed in a displacement cleansing salt bath which contains an alkali metal nitrate.

15 Claims, 1 Drawing Sheet

METHOD OF PRODUCING METAL MEMBER WITH ENHANCED CORROSION RESISTANCE BY SALT BATH NITRIDING

FIELD OF THE INVENTION

This invention relates to a method for enhancing the corrosion resistance of a treated metal member obtained by subjecting a metal member to salt bath nitriding treatment and having high abrasion resistance and fatigue strength imparted thereto as a result of nitriding of its metal.

DESCRIPTION OF THE BACKGROUND

Salt bath nitriding treatment is widely used to improve material properties such as abrasion resistance and fatigue strength of metals, especially iron and steel, by forming both nitrided layers and nitrogen diffusion layers on their surfaces. This salt nitriding treatment is applied not only to plain steel but also to alloy steel such as stainless steel and nickel-based alloys (so-called super alloys) represented by "Inconel" and the like.

Such nitrided layer and nitrogen diffusion layer, which have been obtained by the above-described method, have a function to heighten the surface hardness of the associated metal member such that the metal member is improved in abrasion resistance and fatigue strength and at the same time, is protected from a corrosive loss. Conventional salt bath nitriding treatment, therefore, needs no further treatment insofar as corrosion resistance of an ordinary level is required. Further treatment is, however, needed in an applications where corrosion resistance is required to such an extent as available from hard chromium plating as one of competing surface hardening techniques. To make improvements in the corrosion resistance of metal members nitrided as described, a variety of inventions have been made (see, JP 56-33473 A, JP 60-211062 A, JP 05-263214 A, JP 05-195194 A, JP 07-62522 A, and JP 07-224388 A).

To make further improvements in corrosion resistance, combinations of nitriding treatment and oxidizing bath treatment have also been proposed (see, JP 56-33473 A and JP 07-224388 A). Corrosion resistance available from such combined treatment is stated to be comparable or better compared with hard chromium plating when determined by the salt spraying test. However, the corrosion resistance available from such combinations of salt bath nitriding treatment and oxidizing bath treatment varies so much that their adoption has been avoided in many instances. With a view to overcoming this drawback, it has also been proposed to impregnate a treated product with wax or to coat a treated product with a polymer after the application of the nitriding treatment and oxidizing bath treatment in combination (see, JP 05-195194 A and JP 05-263214 A).

These two methods are intended to achieve both an improvement and stabilization (improved reproducibility) in corrosion resistance by conducting the wax impregnation or polymer coating treatment such that the coefficient of friction is lowered to make an improvement in abrasion resistance and at the same time, an oxide layer is sealed or covered with a wax or polymer coating. These two methods can bring about good material properties such as high abrasion resistance and fatigue strength and at the same time, improvements in corrosion resistance and its reproducibility.

Nonetheless, the incorporation of an impregnation or coating step in addition to oxidizing bath treatment after a nitriding step is not readily acceptable in view of factors such as initial cost, productivity, production cost and the like.

The present inventors, therefore, invented a method of forming an oxide layer, which is excellent in barrier properties, on an outermost surface concurrently with achieving nitriding upon subjecting a metal member, especially an iron-based member to nitriding treatment in a salt bath, and succeeded in imparting corrosion resistance, which is superior to that available from hard chromium plating, in addition to making improvements in material properties such as abrasion resistance and fatigue strength. An application for a patent was filed on the invention (Japanese Patent Application No. 2001-361544, now JP 2002-226963 A).

The above-described method features that upon forming a nitrided layer on a surface of a metal member, especially an iron-based member by immersing the metal member in a molten salt bath containing $Li^+$, $Na^+$ and $K^+$ ions as cation components and $CNO^-$ and $CO_3^{--}$ ions as anion components, the oxidizing power of the salt bath is enhanced by addition of an alkali metal hydroxide, bound water, free water, moist air or the like to form, concurrently with formation of a nitrided layer on a surface of the member, an oxide layer on an outermost surface of the nitrided layer.

The oxide layer is a thin layer composed of a lithium iron oxide layer and having a thickness as small as 0.5 to 5 μm, but is equipped with an excellent barrier function against chlorine ions as a corrosive environment factor and can significantly improve the corrosion resistance of a nitrided metal member. The method disclosed in JP 2002-226963 A is, therefore, expected to find wide-spread utility as a surface hardening method capable of imparting high corrosion resistance as a substitute method for hard chromium plating.

With respect to stainless steel widely employed as a corrosive metal material, salt bath nitriding, ionitriding, gas nitriding and the like are also practiced for applications each of which requires an improvement in surface hardness. These nitriding treatment methods are, however, accompanied by a drawback that a passivated film on a surface of stainless steel is destroyed to impair the corrosion resistance which stainless steel is inherently equipped with (see JP 2001-214256 A) Therefore, the hard chromium plating has been applied for the improvement of surface hardness of stainless steel with inherent corrosion resistance, although the plating film has problems of unsatisfactory adhesion and the like.

The method disclosed in JP 2002-226963 A can form, concurrently with nitriding a surface of stainless steel, a lithium iron chromium oxide layer having good adhesion and high corrosion resistance on an outermost surface. This method is, therefore, expected to find practical utility as a surface hardening method for stainless steel as a substitute method for hard chromium plating.

Reference is next had to FIGS. 1A through 2B. FIGS. 1A and 2A are cross-sectional schematics of surface-modifying layers formed on plain steel and stainless steel, respectively, by a conventional method, while FIGS. 1B and 2B are cross-sectional schematics of surface-modifying layers formed on plain steel and stainless steel, respectively, by the method disclosed in JP 2002-226963 A. In these drawings, there are shown nitrogen diffusion layers 1 (thickness: 0.2 to 1 mm), compound layers 2 (also called "white layers", $Fe_2N$, thickness: 5 to 30 μm), a black lithium iron oxide layer 4 (thickness: 0.5 to 5 μm), nitrogen diffusion layers 11 (thickness: 0.2 to 1 mm), first compound layers 12 (also called "white layers", $Fe_2N+Cr_2N$, thickness: 10 μm), second compound layers 13 (also called "black layers", $CrN+Fe_2N$, thickness: 20 to 80 μm), and a black lithium iron chromium oxide layer 14 (thickness: 0.5 to 5 μm) The lithium iron oxide layer 4 and lithium iron chromium oxide layer 14, both of which have been formed by the method disclosed in JP 2002-226963 A, are extremely thin layers, but are excellent in barrier effects against chlorine ions and the like as corrosive environment factors and contribute to improvements in the corrosion resistance of the nitrided materials. On the other hand, the compound layers 2, 12, 13 shown in the drawings have high hardness and impart superb abrasion resistance to the plain steel and stainless steel. The nitrogen diffusion layers 1 and 11 formed below the compound layers 2 and 12, respectively, are solid solution layers with nitrogen dissolved in the plain steel and stainless steel, respectively. Owing to the compression stress produced as a result of dissolution of nitrogen, the resulting members are provided with significantly-improved fatigue strength.

To obtain such a nitrogen diffusion layer, it is necessary to quench a member from a temperature of at least 300° C. or higher subsequent to its nitriding treatment. In salt bath nitriding by the method disclosed in JP 2002-226963 A, quenching is also conducted at 450 to 650° C. as in conventional salt bath nitriding treatment. Taking into consideration residual strain in the treated product, prohibition of γ' ($Fe_4N$) deposition in a nitrogen diffusion layer, and the like, however, post-nitriding quenching is conducted by one of the following three methods, said one quenching method being selected to obtain target material properties:

Salt bath nitriding→water quenching→hot water rinsing→drying.

Salt bath nitriding→oil quenching→hot water rinsing→drying.

Salt bath nitriding→air quenching→hot water rinsing→drying.

Water quenching is the highest in quenching rate, and is adopted when importance is placed on the inhibition of γ' ($Fe_4N$) deposition in a nitrogen diffusion layer. Air quenching, on the other hand, is the lowest in quenching rate and is adopted when importance is placed on the inhibition of residual strain. Oil quenching is selected in view of a balance between quenching rate and strain. To achieve both of the prevention of residual strain and the inhibition of γ' ($Fe_4N$) deposition, air quenching may be applied to around 400° C., following by water quenching.

As one example of the compositions of conventional molten salt nitriding baths, the following composition can be mentioned: 35 wt. % $CNO^-$, 18 wt. % $CO_3^{--}$, 3.5 wt. % $Li^+$, 18 wt. % $Na^+$, 22.5 wt. % $K^+$, and 3 wt. % $CN^-$ (hereinafter called "the salt bath C"). As an illustrative composition of a molten salt nitriding bath for use in the method disclosed in JP 2002-226963 A, on the other hand, the following composition can be mentioned: 15 wt. % $CNO^-$, 40 wt. % $CO_3^{--}$, 4 wt. % $Li^+$, 18 wt. % $Na^+$, 22.5 wt. % $K^+$, and 0.5 wt. % $CN^-$ (hereinafter called "the salt bath N").

To permit formation of an oxide layer on an outermost layer concurrently with nitriding, the salt bath for use in the method disclosed in JP 2002-226963 A has such a formula design that contains $CNO^-$, a source component for the formation of cyanide, at a minimized level to reduce $CN^-$, which is a reducing substance and has dissolving action on iron oxides, to as low a concentration as possible. As a result, the proportion of a carbonate having a relatively low solubility in water is greater compared with the corresponding proportion in the conventional bath.

Subsequent to the salt bath nitriding, the treated product is subjected to water quenching (or oil quenching or air quenching) to quench it, and is then rinsed with hot water in the subsequent step. As the conventional salt bath contains a cyanate, which has high solubility in water, in a large proportion, the molten salt adhered on the treated product can be readily dissolved and rinsed off with water. In the salt bath for use in the method disclosed in JP 2002-226963 A, on the other hand, the carbonate which is lower in solubility than the cyanate is contained in a large proportion. The molten salt dragged out in a state adhered on the treated product, therefore, tends to remain on the treated product without being completely rinsed off with water where the treated product is a part of complex configurations, although such a molten salt can be readily rinsed off with water in the case of a part of simple configurations. In general, no molten salt is allowed to adhere and remain on a treated product. Especially in the case of a molten salt nitriding bath in which by produced cyanides exist although they are contained only in trace amounts, the molten salt is by no means allowed to remain on the treated product.

In the salt bath composition for use in the method disclosed in JP 2002-226963 A, the reduction in the content of the cyanate is replaced by the carbonate for the reasons to be mentioned next. The nitriding of steel in a salt bath is known to take place by solid diffusion of nascent nitrogen, which is produced by decomposition of a cyanate by the following formula (1) or (2), into the steel:

$$4MeCNO \rightarrow 2MeCN + Me_2CO_3 + CO + 2N \quad (1)$$

$$5MeCNO \rightarrow 3MeCN + Me_2CO_3 + CO_2 + 2N \quad (2)$$

wherein Me represents a monovalent alkali metal.

The cyanide formed by the reaction of the formula (1) or (2) is considered to be an effective component, because it is oxidized and converted back into the effective cyanate through the following reaction by salt bath aeration conducted as a standard procedure upon performing salt bath nitriding:

$$2MeCN + O_2 \rightarrow 2MeCNO \quad (3)$$

The carbonate formed by the reaction of the formula (1) or (2), on the other hand, accumulates as the salt bath nitriding treatment proceeds. Before the technique disclosed in JP 51-5024A was invented, cyanate the content of which dropped through the treatment was replenished with an alkali metal cyanide. Due to accumulation of the unnecessary carbonate, however, the replenishment of a fresh supply of the alkali metal cyanate was hardly feasible unless a portion of the salt bath was discarded. The invention disclosed in JP 51-50241 A made it possible to maintain the concentration of a cyanate in the salt bath without pumping out the old salt, which contains a toxic cyanide, by reacting a useless carbonate, which is contained in the salt bath, with a nitrogen-containing organic compound to convert it back directly into the effective cyanate.

The conversion back into the cyanate when urea is used as a nitrogen-containing compound can be represented by the following formula:

$$Me_2CO_3 + 2CO(NH_2)_2 \rightarrow 2MeCNO + 2NH_3 + CO_2 + H_2O \quad (4)$$

The above description is believed to make it possible to understand the inevitability of the salt bath composition of $MeCN/MeCNO/Me_2CO_3$, that is, the reason for the replacement of the reduction in the content of MeCNO with $Me_2CO_3$.

SUMMARY OF THE INVENTION

The present inventors, therefore, have proceeded with an extensive investigation to find out a cleansing method for the salt bath employed in the method disclosed in JP 2002-226963 A. As a result, it has been found that displacement cleansing with a salt bath of a particular composition subsequent to salt bath nitriding treatment makes it possible to completely dissolve and eliminate the molten salt on the treated product by rinsing it with hot water in a subsequent rinsing step even if the product is a part of complex configurations and also that the displacement cleansing with the salt bath of the particular composition makes it possible to further improve the level of corrosion resistance. Consequences which have led to the above findings will be described hereinafter.

Using two kinds of molten salt nitriding baths which consisted of the above-described salt bath N and salt bath C, the present inventors set engine valves on predetermined jigs and treated. The treatment was conducted through the following steps:

Alkaline cleansing→hot water rinsing→drying→preheating→salt bath nitriding→water quenching→hot water rinsing→drying.

After to the treatment, the treated engine valves were inspected for the salt possibly remaining on them. No remaining salt was observed at all on the engine valves treated with the conventional salt bath (salt bath C), but in the case of the engine valves treated with the salt bath (salt bath N) useful for the method disclosed in JP 2002-226963 A, the salt remained a little on their valve heads and further, the salt occurred in an icicle like form on the lower parts of their valve stems subsequent to pulling the treated engine valves out of the salt bath remained without complete dissolution in the subsequent hot water rinsing step.

With respect to the jigs employed for setting the engine valves to be treated, no remaining salt was observed on those employed for the treatment with the salt bath C, but in the treatment with the salt bath N, the remaining salt was visually observed on the jigs. The salt bath N and the salt bath C were then compared in the dissolution rate in water. From the respective salt baths, small amounts of the salts were pumped out. After they were allowed to cool down into solids, the solids were separately ground in tartars, and by sifting, −4-mesh +50-mesh fractions were collected as specimens and were provided for a dissolution rate test.

While stirring 50 mL aliquots of water by magnetic stirrers with their temperatures controlled at 50° C., 1 g aliquots of the powdery specimens of the respective salt baths, said powdery specimens having been prepared as described above, were added, and the times until complete dissolution were measured for the respective salt bath specimens. As a result, the specimen of the salt bath N requires 592 seconds until complete dissolution, whereas the specimen of the salt bath C completely dissolved in 182 seconds. From this result, it has also become clear that the salt bath for use in the method disclosed in JP 2002-226963 A has a considerably low dissolution rate in water. The lower rinse property of the salt bath N for use in the method disclosed in JP 2002-226963 A than the salt bath C as a conventional bath is attributed to its low water solubility.

As another factor for the post-rinsing, salt remaining problem of the salt bath N for use in the method disclosed in JP 2002-226963 A, solidification of the adhered salt can be mentioned. This solidification takes place due to temperature drops after pulling the treated products out of the salt bath until their transfer to the next step, that is, water quenching. The above-described troublesome remaining of the salt in an icicle like form on the lower parts of the steps of the engine valves is a typical example of such solidification.

There is, however, a limitation on any attempt to shorten the time required to pull the treated products out of the salt bath and then to transfer them to the next water quenching step such that solidification of the adhered salt would be avoided. To reduce loads on the production cost and the environment, drag-out of the molten salt adhered on the treated products and jigs must be controlled to as small an amount as possible. A sufficient drip time must, therefore, be allocated to permit salt elimination.

The solidification point of a salt bath usable in the method disclosed in JP 2002-226923 A as represented by the salt bath N varies depending on the composition of the salt bath, and its solidification does not take place clearly. In general, however, the solidification point falls within a range of from 350 to 430° C. With a view to overcoming this problem, the present inventors conducted an investigation on a method for having the salt of a nitriding salt bath, said salt having been dragged out in a state adhered to treated products, displaced with a molten salt having higher water solubility in a subsequent step.

As a result, it has been found that displacement of the salt with a molten salt containing an alkali metal nitrate, which is readily soluble in water and shows a low melting point (solidification temperature), is effective for the improvement of the rinse property. It has also been found that a treated product is substantially improved in corrosion resistance by displacement with the molten salt which contains the alkali metal nitrate. In addition, it has also been found that $CN^-$ ions in the salt of the nitriding salt bath, said salt having been dragged in in a state adhered to the treated product, can be oxidatively decomposed and detoxified by the alkali metal nitrate.

In one aspect of the present invention, there is thus provided a method of producing a metal member with enhanced corrosion resistance by salt bath nitriding. The method includes forming an nitrided layer on a surface of the metal member and concurrently, an oxide film on an outermost layer of the nitrided layer by immersing the metal member in a nitriding salt bath containing $Li^+$, $Na^+$ and $K^+$ ions as cation components and $CNO^-$ and $CO_3^{--}$ ions as anion components and enhanced in oxidizing power by addition of an oxidizing-power-enhancing substance selected from the group consisting of alkali metal hydroxides, bound water, free water and moist air. As a subsequent step to the immersion in the nitriding salt bath, the method comprises immersing the metal member in a displacement cleansing salt bath which contains an alkali metal nitrate.

According to the present invention as described above, treatment is conducted with the displacement cleansing salt bath of the specific composition after the salt bath nitriding treatment. This makes it possible to completely dissolve and eliminate the molten salt from the treated metal member by rinsing it in a subsequent step even if the metal member is a part of complex configurations. Further, preparation of the displacement cleansing salt bath with a specific composition can make a further improvement in the level of corrosion resistance.

Further, salt-displacement treatment with a molten salt containing an alkali metal nitrate can make a considerable improvement in the corrosion resistance of the treated product, and further, $CN^-$ ions in the salt of the nitriding salt bath, said salt having been dragged in in a state adhered to the treated product, can be oxidatively decomposed and detoxified by the alkali metal nitrate. Therefore, total cyanide is not detected at all in a water-quenching bath. Further, total cyanide does not exist either in hot water rinsings to be discharged from the treatment line. The hot water rinsings can, therefore be discharged after conducting only neutralization treatment thereon.

DETAILED DESCRIPTION OF THE INVENTION AND PREFERRED EMBODIMENTS

Figure 1A:
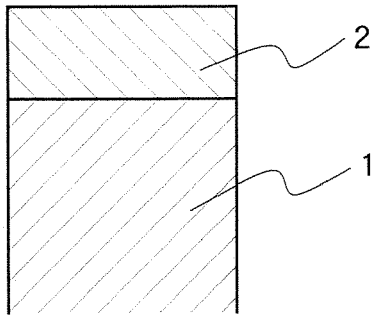
Fig.1A PRIOR ART
FIG. 1A is a cross-sectional schematic of surface-modifying layers formed on plain steel by conventional salt bath nitriding treatment.

The present invention will next be described in further detail based on preferred embodiments. The present invention makes further improvements in the method disclosed in JP 2002-226963 A. Details of the method have been described above in detail, and will also be described specifically in Examples to be described subsequently herein. As described above, the method disclosed in JP 2002-226963 A involves the problem that even after treatment of a product, the salt of the salt bath still remains in a state adhered on the treated product. With a salt bath containing a salt of high water solubility as will be described subsequently herein, the present invention treats the thus-nitrided product to displace the remaining salt with the salt of high water solubility. In addition, the present invention can also bring about other pronounced advantageous effects.

Examples of the alkali metal nitrate employed in the displacement cleansing salt bath, which primarily features the present invention, can include sodium nitrate, potassium nitrate and lithium nitrate. Although these alkali metal nitrates can be used singly, selection of a binary system of a composition at or around an eutectic point of two salts chosen from these three salts or a ternary system of a composition at or around an eutectic point of the three salts leads to a melting point substantially lower than those of the individual salts, so that the displacement cleansing salt bath can be used in a lower temperature range. In addition, the selection of such a binary or ternary system also permits dripping for a longer time provided that the treatment temperature is the same. It is, therefore, possible to reduce drag-out of the salt into the next step. Combined use of plural alkali metal nitrates is, therefore, more advantageous although a single alkali metal nitrate can still be used as a displacement cleansing salt bath.

The present inventors have also found that the rinse property of the nitriding salt adhered on the treated product and the corrosion resistance of the treated product can be enhanced by adding one or both of an alkali metal hydroxide and an alkali metal nitrite. Examples of the alkali metal hydroxide can include sodium hydroxide, potassium hydroxide and lithium hydroxide, while examples of the alkali metal nitrite can include sodium nitrite, potassium nitrite and lithium nitrite (monohydrate).

Addition of the alkali metal hydroxide to the displacement cleansing salt bath is effective in lowering the melting point of the displacement cleansing salt bath and also in melting and stripping the nitriding salt, which is adhered on the treated product, by its alkali fusion action. The addition of the alkali metal nitrite to the displacement cleansing salt bath is effective not only in lowering the melting point of the displacement cleansing salt bath like the addition of the alkali metal hydroxide, but also in enhancing the oxidizing power of the displacement cleansing salt bath to contribute to the sealing of an lithium iron oxide layer formed on an outermost layer by the molten salt nitriding bath employed in the method disclosed in JP 2002-226963 A and hence, to significantly improve the corrosion resistance of the treated product.

Combined addition of the alkali metal hydroxide and the alkali metal nitrite to the displacement cleansing salt bath can synergistically improve the cleansing property of the displacement cleansing salt bath and the corrosion resistance of the treated product, and therefore, is a most desirable embodiment. It is preferred to conduct the treatment with the displacement cleansing salt bath at 200° C. or higher for the displacement and cleansing of the salt of the nitriding salt bath and also for the oxidative decomposition of $CN^-$ ions contained in the sale of the nitriding salt bath, although the treatment with the displacement cleansing salt bath can be practiced above the melting point (solidification point) of the salt bath. The temperature of the displacement cleaning salt bath should, however, be controlled at 550° C. or lower because decomposition of the nitrate begins if it exceeds 550° C.

The concentration of nitrogen dissolved in steel, on the other hand, varies in proportion to the temperature. To obtain a nitrogen diffusion layer (nitrogen dissolved layer), which exhibits anti-fatigue strength, without causing the dissolved nitrogen to deposit as γ' ($Fe_4N$), it is necessary to quench the member, which has been subjected to nitriding treatment, from a temperature as high as at least 300° C. or higher. Hence, the temperature of the displacement cleansing salt bath is desirably in a range of from 300 to 550° C.

No matter which quenching method is employed, the displacement cleansing step in the present invention is practiced as a subsequent step to the salt bath nitriding treatment as shown below:

Salt bath nitriding→displacement cleansing treatment→water quenching→hot water rinsing→drying.

Salt bath nitriding→displacement cleansing treatment→oil quenching→hot water rinsing→drying.

Salt bath nitriding→displacement cleansing treatment→air quenching→hot water rinsing→drying.

After the salt bath nitriding treatment, $CN^-$ ions are contained at a concentration of 0.5 wt. % or so in the salt of the nitriding salt bath, said salt having been dragged out in a state adhered to the treated product. In a water quenching bath arranged to perform a similar process except for the exclusion of the displacement cleansing treatment, total cyanide is detected to range from 20 to 200 ppm or so in the course of treatment. It is to be noted that an iron-cyano complex and free cyanide exist together in the water quenching bath although total cyanide exist as free cyanide in the nitriding salt bath. As the water in the water quenching tank is dragged into the hot water rinsing tank in the next step, it is necessary to conduct high-performance effluent treatment upon discharging hot water rinsings such that the iron-cyano complex and free cyanide are detoxified.

In a process in which treatment with a displacement cleansing salt bath, which contains an alkali metal nitrate, is incorporated as in the present invention, on the other hand, $CN^-$ ions contained in the salt of the nitriding salt bath, said salt having been dragged in a state adhered on a treated product, are oxidatively decomposed and completely detoxified with nitrate to nitrogen gas and carbon dioxide. Therefore, total cyanide is not detected at all in a water quenching bath employed in this process. Further, total cyanide does not exist at all either in hot water rinsings to be discharged from the treatment line. The hot water rinsings can, therefore bed is charged after conducting only neutralization treatment thereon.

The corrosion resistance of the treated product can be significantly improved by coating it with a water-dilutable resin by a method such as dipping or spraying after rinsing it with hot water subsequent to quenching or after drying it subsequent to the hot water rinsing. The water-dilutable resin employed for the above-mentioned purpose preferably has an acid value in a range of from 20 to 300. An acid value smaller than 20 may not provide sufficient adhesion with the base metal so that no sufficient wet corrosion resistance would be available. An acid value greater than 300, on the other hand, may lead to excessively strong water sensitivity so that waterproofness would be lowered to result in reduced corrosion resistance. The dry coat weight of the water-dilutable resin may desirably be in a range of from 0.1 to 5 $g/m^2$. A dry coat weight smaller than 0.1 $g/m^2$ may lead to insufficient barrier properties so that no sufficient corrosion resistance would be available. A dry coat weight greater than 5 $g/m^2$ may, on the other hand, may lead to saturation in the corrosion resistance improving effect and hence, may result in an economical disadvantage.

Figure 1B:
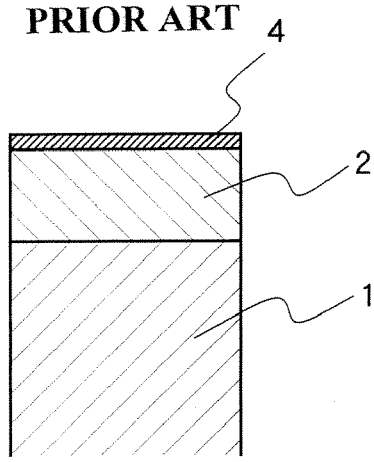
Fig.1B PRIOR ART
FIG. 1B is a cross-sectional schematic of surface-modifying layers formed on plain steel by the method disclosed in JP 2002-226963 A.
Figure 2A:
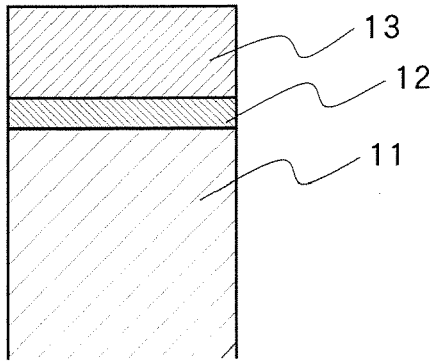
FIGS. 2A and 2B are similar to FIGS. 1A and 1B, respectively, except that the treated material was stainless steel.
Figure 2B:
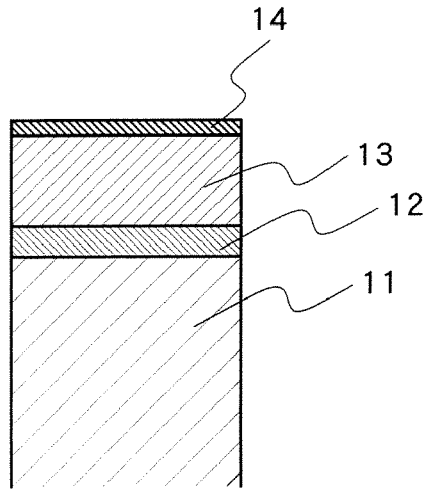

As illustrated in FIGS. 1B to 2B, the nitriding method according to the present invention forms a black oxide layer of 0.5 to 5 μm in thickness on an outermost surface of the surface-modifying layers. There is a need for black finishing of iron-based parts in a wide variety of fields such as cameras, OA equipment, automobile parts, and office equipment. Especially where luxurious visual impressions unavailable from black coating are required, treatment is applied to form magnetite on surfaces by black oxide coating by chemical treatment (chemical blackening). As no corrosion resistance is expected from this treatment alone, treatment with a rust preventive oil or the like is needed so that a limitation is imposed on the application field of products so treated by chemical blackening.

The oxide layer formed on an outermost surface of steel by the nitriding method according to the present invention is a black film having excellent adhesion with the base material and also high corrosion resistance. Products treated by the nitriding method of the present invention can, therefore, be furnished, as are, for practical use without application of any special treatment such as oil coating. Further, the black film is not easily peeled off even by buffing or the like, and therefore, can be bright-finished without any substantial reduction in corrosion resistance while retaining its black outer appearance.

EXAMPLES

The present invention will hereinafter be described in further detail based on Examples and Comparative Examples. It should, however, be borne in mind that the following Examples are merely illustrative and should by no means be taken as restricting the present invention.

Example 1

Engine valves (material: SUH11) were set on predetermined jigs. Separately using the nitriding salt bath disclosed in JP 2002-226923 A and the above-described salt bath N as nitriding salt baths and also separately employing salt baths B1 to B4 shown in Table 1 as displacement cleansing salt baths, the engine valves were treated by the below-described process. As a comparative example, treatment was conducted without displacement cleansing treatment in the below-described step (6). After drying in the below-described step (9), the treated products and frames of the jigs employed for the treatment were visually observed for any remaining salt thereon to perform determine their rinse property.

| Salt bath nitriding treatment process | |
|---|---|
| (1) Alkali cleaning | Cleaner: "PK-5190" (trade name, product of Parker Netsushori Kogyo K. K.) Concentration: 4 wt. % Treatment conditions: 70° C. × 10 min |
| (2) Water rinsing | Treatment conditions: 40° C. × 5 min |
| (3) Drying | Treatment conditions: 100° C. × 10 min |
| (4) Preheating | Treatment conditions: 400° C. × 20 min |
| (5) Salt bath nitriding treatment | Nitriding salt bath: Salt bath N Treatment conditions: 580° C. × 30 min Dripping: 2 min (suspended in a space over the nitriding salt bath) |
| (6) Displacement cleansing treatment | Displacement cleansing baths: See Table 1 Treatment conditions: 400° C. × 15 min Dripping: 2 min (suspended in a space over the displacement cleansing bath) |
| (7) Water quenching | Treatment conditions: 40° C. × 5 min |
| (8) Hot water rinsing | Treatment conditions: 50° C. × 10 min |
| (9) Drying | Treatment conditions: 100° C. × 10 min |

TABLE 1

Compositions of Displacement Cleansing Baths (wt. %)

| Bath No. | $NaNO_3$ | $KNO_3$ | NaOH | $NaNO_2$ |
|---|---|---|---|---|
| B1 | 55 | 45 | — | — |
| B2 | 52 | 43 | 5 | — |
| B3 | — | 55 | — | 45 |
| B4 | — | 52 | 5 | 43 |

Determination of Rinse Property

As a result of the visual observation, the engine valves treated with the displacement cleansing baths B1 to B4, all of which are useful in the present invention, respectively, no remaining salt was observed at all on any one of the head portions of the engine valves. At the dripping stage after the engine valves were pulled out of the corresponding nitriding salt baths, the salts appeared in an icicle like form on lower parts of the valve stems, respectively. However, those salts were completely dissolved in the water quenching step and, when the engine valves were pulled out of a water quenching tank, were no longer visible. As a result of the visual observation of the engine valve of the comparative example treated without the displacement cleansing treatment step, on the other hand, the salt was observed to remain on its head portion and also to remain in an icicle like form on a lower part of the valve stem.

Concerning the jigs employed for setting the engine valves for the treatment, similar results were obtained.

Described specifically, no remaining salt was observed at all on the jigs employed for the treatment with the displacement cleansing baths B1 to B4 useful in the present invention, but the salt was visually observed to remain on the jig employed in the comparative example in which the displacement cleansing treatment step was omitted.

Example 2

Steel sheets of 0.8 mm thick, 50 mm wide and 100 mm long (material: SPCC) were subjected to salt bath nitriding treatment by the below-described process to form nitrided layers on the surfaces of the respective steel sheets and also to concurrently form lithium iron oxide layers on outermost surfaces of the nitrided layers, respectively. For the displacement cleansing treatment in the step (6), the salt baths B1 to B4 shown in Table 1 were used separately. Treatment by a similar process except for the omission of the displacement cleaning treatment in the step (6) was conducted as a comparative example for the above-mentioned present invention.

The steel sheets subjected to the above-described treatment (including the comparative example) each presented a black external appearance. Cross-sections of those treated products were ground and etched, and were then observed under an optical microscope. Each of the specimens was confirmed to include an iron nitride layer (compound layer: white layer) of approximately 15 μm in thickness and also an oxide layer (black layer) of approximately 2 μm thickness on an outermost surface of the iron nitride layer.

| Salt bath nitriding treatment process | |
|---|---|
| (1) Alkali cleaning | Cleaner: "PK-5190"<br>(trade name, product of Parker Netsushori Kogyo K. K. )<br>Concentration: 4 wt. %<br>Treatment conditions: 70° C. × 10 min |
| (2) Water rinsing | Treatment conditions: 40° C. × 2 min |
| (3) Drying | Treatment conditions: 100° C. × 5 min |
| (4) Preheating | Treatment conditions: 350° C. × 20 min |
| (5) Salt bath nitriding treatment | Nitriding salt bath: Salt bath N<br>Treatment conditions: 580° C. × 90 min<br>Dripping: 10 sec (suspended in a space over the nitriding salt bath) |
| (6) Displacement cleansing treatment | Displacement cleansing baths:<br>See Table 1<br>Treatment conditions: 400° C. × 15 min<br>Dripping: 10 sec (suspended in a space over the displacement cleansing bath) |
| (7) Water quenching | Treatment conditions: 40° C. × 2 min |
| (8) Hot water rinsing | Treatment conditions: 50° C. × 2 min |
| (9) Drying | Treatment conditions: 100° C. × 10 min |

To determine the corrosion resistance of the steel sheets subjected to the above-described treatment, a salt spray test was conducted by JIS Z 2371. The results are shown in Table 2.

TABLE 2

Results of Corrosion Resistance Test
(Time required until rust formation)

| Treatment No. | Treatment with displacement cleansing bath | Treated product Steel sheet (SPCC) |
|---|---|---|
| Comparative Example | No applied | 240 hr |
| Invention 1 | B1 | 408 hr |

TABLE 2-continued

Results of Corrosion Resistance Test
(Time required until rust formation)

| Treatment No. | Treatment with displacement cleansing bath | Treated product Steel sheet (SPCC) |
|---|---|---|
| Invention 2 | B2 | 480 hr |
| Invention 3 | B3 | 504 hr |
| Invention 4 | B4 | 816 hr |

Example 3

Cold-finished steel bars of 10 mm in diameter and 150 mm in length (material: S20C) were subjected to salt bath nitriding treatment by the below-described process up to the step (9) to form nitrided layers on surfaces of the steel bars and also to concurrently form lithium iron oxide layers on outermost surfaces of the nitrided layers, respectively. For the displacement cleansing treatment in the step (6), the salt baths B1 to B4 shown in Table 1 were used separately. Treatment by a similar process except for the omission of the displacement cleaning treatment in the step (6) was conducted as a comparative example for the above-mentioned present invention.

The cold-finished steel bars subjected to the above-described treatment (including the comparative example) each presented a black external appearance. Cross-sections of those treated products were ground and etched, and were then observed under an optical microscope. Each of the specimens was confirmed to include an iron nitride layer (compound layer: white layer) of approximately 15 μm in thickness and also an oxide layer (black layer) of approximately 2 μm in thickness on an outermost surface of the iron nitride layer.

Buffing was applied to half of the treated products of the present invention and the treated products of the comparative example (10 cold-finished steel bars in total) to finish them to a surface roughness of 0.2 μm in terms of Ra. The cold-finished bars subjected to the above-described treatment (including the comparative example) each presented a black external appearance, and even after the buffing, their black external appearances were retained. As a result of the buffing, the thickness of each oxide layer decreased by about 0.3 μm.

| Salt bath nitriding treatment process | |
|---|---|
| (1) Alkali cleaning | Cleaner: "PK-5190"<br>(trade name, product of Parker Netsushori Kogyo K. K.)<br>Concentration: 4 wt. %<br>Treatment conditions: 70° C. × 10 min |
| (2) Water rinsing | Treatment conditions: 40° C. × 5 min |
| (3) Drying | Treatment conditions: 100° C. × 10 min |
| (4) Preheating | Treatment conditions: 400° C. × 20 min |
| (5) Salt bath nitriding treatment | Nitriding salt bath: Salt bath N<br>Treatment conditions: 580° C. × 30 min<br>Dripping: 2 min (suspended in a space over the nitriding salt bath) |
| (6) Displacement cleansing treatment | Displacement cleansing baths:<br>See Table 1<br>Treatment conditions: 400° C. × 15 min<br>Dripping: 2 min (suspended in a space over the displacement cleansing bath) |
| (7) Water quenching | Treatment conditions: 40° C. × 5 min |

-continued

| Salt bath nitriding treatment process | |
|---|---|
| (8) Hot water rinsing | Treatment conditions: 50° C. × 10 min |
| (9) Drying | Treatment conditions: 100° C. × 10 min |
| (10) Buffing | Passed once |

To determine the corrosion resistance of the cold-finished steel bars subjected to the above-described treatment, a salt spray test was conducted by JIS Z 2371. The results are shown in Table 3.

TABLE 3

Results of Corrosion Resistance Test (Time required until rust formation)

| Treatment No. | Treatment with displacement cleansing bath | Treated product (cold-finished steel bars: S20C) No buffing | Buffing applied |
|---|---|---|---|
| Comparative Example | No applied | 120 hr | 96 hr |
| Invention 1 | B1 | 336 hr | 312 hr |
| Invention 2 | B2 | 408 hr | 408 hr |
| Invention 3 | B3 | 432 hr | 408 hr |
| Invention 4 | B4 | 744 hr | 720 hr |

Example 4

Stainless steel sheets of 0.8 mm thick, 50 mm wide and 100 mm long (material: SUS304) were subjected to salt bath nitriding treatment by the below-described process to form nitrided layers on the surfaces of the respective stainless steel sheets and also to concurrently form lithium iron chromium oxide layers on outer most surfaces of the nitrided layers, respectively. For the displacement cleansing treatment in the step (6), the salt baths B1 to B4 shown in Table 1 were used separately. Treatment by a similar process except for the omission of the displacement cleaning treatment in the step (6) was conducted as a comparative example (Comparative Example 1) for the above-mentioned present invention.

Using the conventional nitriding bath (the salt bath C) as a nitriding salt bath, a stainless steel sheet of 0.8 mm thick, 50 mm wide and 100 mm long (material: SUS304) was treated as Comparative Example 2 by a similar process as described below except for the omission of the displacement cleansing treatment.

Cross-sections of those treated products were ground and etched, and were then observed under an optical microscope. The stainless steel sheets treated with the salt bath N were each observed to include a black oxide layer of about 3 μm in thickness as an outermost layer, a black layer ($CrN+Fe_2N$) of about 50 μm in thickness under the oxide layer, and further, a white layer ($Fe_2N+Cr_2N$) of approximately 10 μm in thickness under the black layer. In the case of the specimen treated with the salt bath C, on the other hand, there were observed a black layer ($CrN+Fe_2N$) of about 50 μm in thickness and under the black layer, a white layer ($Fe_2N+Cr_2N$) of approximately 10 μm in thickness. However, no oxide layer was observed on an outermost surface.

| Salt bath nitriding treatment process | |
|---|---|
| (1) Alkali cleaning | Cleaner: "PK-5190" (trade name, product of Parker Netsushori Kogyo K. K.) Concentration: 4 wt. % Treatment conditions: 70° C. × 10 min |
| (2) Water rinsing | Treatment conditions: 40° C. × 2 min |
| (3) Drying | Treatment conditions: 100° C. × 5 min |
| (4) Preheating | Treatment conditions: 350° C. × 20 min |
| (5) Salt bath nitriding treatment | Nitriding salt bath: Salt bath N or salt bath C (Comparative Example 2) Treatment conditions: 580° C. × 90 min Dripping: 10 sec (suspended in a space over the nitriding salt bath) |
| (6) Displacement cleansing treatment | Displacement cleansing baths: See Table 1 Treatment conditions: 400° C. × 15 min Dripping: 10 sec (suspended in a space over the displacement cleansing bath) |
| (7) Water quenching | Treatment conditions: 40° C. × 2 min |
| (8) Hot water rinsing | Treatment conditions: 50° C. × 2 min |
| (9) Drying | Treatment conditions: 100° C. × 10 min |

To determine the corrosion resistance of the stainless steel sheets subjected to the above-described treatment, a salt spray test was conducted by JIS Z 2371. The results are shown in Table 4.

TABLE 4

Results of Corrosion Resistance Test

| Treatment No. | Nitriding salt bath | Treatment with displacement cleansing bath | Time until rust formation |
|---|---|---|---|
| Comparative Example 1 | Salt bath C | Not applied | 6 hr |
| Comparative Example 2 | Salt bath N | Not applied | 96 hr |
| Invention 1 | Salt bath N | B1 | 504 hr |
| Invention 2 | Salt bath N | B2 | 720 hr |
| Invention 3 | Salt bath N | B3 | 768 hr |
| Invention 4 | Salt bath N | B4 | 1200 hr |

Example 5

A steel sheet of 0.8 mm thick, 50 mm wide and 100 mm long (material: SPCC) was treated with the displacement cleansing bath B1 shown in Table 1 by a similar process as the process of Example 2 except that between the step (8) and the step (9), the steel sheet was dipped in a liquid formulation, which had been prepared by diluting a water-dilutable resin ("HYTEC S-3121", trade name, product of Toho Chemical Industry Co., Ltd., acid value: 150) such that non-volatiles accounted for 5 wt. %, to form a resin coating of 0.7 $g/m^2$ as an outermost layer. To determine the corrosion resistance of the specimen, a salt spray test was conducted by JIS Z 2371. To confirm the effect of the resin coating, a specimen obtained in a similar manner as described above except for the omission of the dipping in the liquid formulation was subjected to a salt spray test for the sake of a comparison.

TABLE 5

| Results of Corrosion Resistance Test (Time required until rust formation) | | |
|---|---|---|
| Treatment No. | Coating of water-dilutable resin | Treated product Steel sheet (SPCC) |
| Invention 1 | No applied | 408 hr |
| Invention 2 | Applied with "HYTEC S-3121" | 1056 hr |

This application claims the priority of Japanese Patent Application 2002-258619 filed Sep. 4, 2002, which is incorporated herein by reference.

The invention claimed is:

1. A method of producing a metal member with enhanced corrosion resistance by salt bath nitriding, said method including forming a nitrided layer on a surface of said metal member and concurrently, an oxide film on an outermost layer of said nitrided layer by immersing said metal member in a nitriding salt bath containing $Li^+$, $Na^+$ and $K^+$ ions as cation components and $CNO^-$ and $CO_3^{--}$ ions as anion components and enhanced in oxidizing power by addition of an oxidizing-power-enhancing substance selected from the group consisting of alkali metal hydroxides, bound water, free water and moist air, which comprises, as a subsequent step to said immersion in said nitriding salt bath, immersing said metal member in a displacement cleansing salt bath, wherein the displacement cleansing salt bath is obtained by adding an alkali metal hydroxide and an alkali metal nitrite into a salt bath containing primarily at least one member selected from the group consisting of sodium nitrate, potassium nitrate and lithium nitrate, so that the displacement cleansing salt bath comprises the alkali metal hydroxide, from 43 to 45 wt % of alkali metal nitrite and from 52 to 55 wt % of alkali metal nitrate;

the alkali metal hydroxide is at least one member selected from the group consisting of sodium hydroxide, potassium hydroxide and lithium hydroxide; and the alkali metal nitrite is at least one member selected from the group consisting of sodium nitrite, potassium nitrite and lithium nitrite.

2. A method as defined in claim 1, wherein said displacement cleansing salt bath is controlled at a temperature of from 300 to 550° C.

3. A method as defined in claim 1, further comprising, subsequent to said immersion in said displacement cleansing salt bath, quenching said metal member with a quenching medium selected from the group consisting of water, oil and air, and then rinsing said metal member with hot water.

4. A method as defined in claim 3, further comprising, subsequent to said rinsing with hot water, coating said metal member with a water-dilutable resin.

5. A method as defined in claim 4, wherein said water-dilutable resin has an acid value in a range of from 20 to 300.

6. A method as defined in claim 4, wherein said water-dilutable resin is applied to give a dry coat weight of from 0.1 to 5 $g/m^2$.

7. A method as defined in claim 3, wherein an effluent from said rinsing is free of any cyanide.

8. A method as defined in claim 1, further comprising partially grinding a black oxide layer, which has been formed on said outermost layer of said metal member by said immersion in said displacement cleansing salt bath, to apply a bright black finish.

9. A method as defined in claim 3, wherein said displacement cleansing salt bath is controlled at a temperature of from 300 to 550° C.

10. A method as defined in claim 3, further comprising partially grinding a black oxide layer, which has been formed on said outermost layer of said metal member by said immersion in said displacement cleansing salt bath, to apply a bright black finish.

11. A method as defined in claim 9, further comprising partially grinding a black oxide layer, which has been formed on said outermost layer of said metal member by said immersion in said displacement cleansing salt bath, to apply a bright black finish.

12. A method as defined in claim 9, wherein an effluent from said rinsing is free of any cyanide.

13. A method as defined in claim 1, wherein the at least one member selected from the group consisting of sodium nitrate, potassium nitrate and lithium nitrate is at least one of sodium nitrate and potassium nitrate.

14. A method as defined in claim 1, wherein the alkali metal hydroxide is sodium hydroxide.

15. A method as defined in claim 1, wherein the alkali metal nitrite is sodium nitrite.

* * * * *